US006769542B2

(12) United States Patent
Polito

(10) Patent No.: US 6,769,542 B2
(45) Date of Patent: Aug. 3, 2004

(54) MULTI PURPOSE BATHROOM STORAGE ACCESSORY

(75) Inventor: Charlie J. Polito, Fountain Hills, AZ (US)

(73) Assignee: Charles J. Polito, Fountain Hills, AZ (US)

( * ) Notice: Subject to any disclaimer, the term of this patent is extended or adjusted under 35 U.S.C. 154(b) by 192 days.

(21) Appl. No.: 10/095,746

(22) Filed: Mar. 13, 2002

(65) Prior Publication Data

US 2003/0173243 A1 Sep. 18, 2003

(51) Int. Cl.[7] ..... B65D 83/10
(52) U.S. Cl. ..... 206/361; 206/372; 206/349
(58) Field of Search ..... 206/361, 372, 206/349; D6/524, 527, 551; 4/255.11; 312/206; 220/23.4

(56) References Cited

U.S. PATENT DOCUMENTS

| | | | | | |
|---|---|---|---|---|---|
| 3,429,474 | A | * | 2/1969 | Cann | 220/555 |
| 4,133,445 | A | * | 1/1979 | Mandelbaum | 220/23.4 |
| 4,192,561 | A | * | 3/1980 | Gunn | 312/42 |
| 4,211,750 | A | * | 7/1980 | Gillespie | 422/123 |
| 4,273,392 | A | * | 6/1981 | Stinson | 312/42 |
| 4,432,451 | A | * | 2/1984 | Hooser | 206/216 |
| 4,542,930 | A | * | 9/1985 | Adams | 294/160 |
| 4,765,475 | A | * | 8/1988 | Kaysserian | 206/394 |
| 5,040,679 | A | * | 8/1991 | Rehmann | 206/457 |
| D356,893 | S | | 4/1995 | Conmy | D4/116 |
| 5,456,356 | A | * | 10/1995 | Kurzawa | 206/349 |
| D403,906 | S | | 1/1999 | Gotti | D6/524 |
| 5,890,588 | A | * | 4/1999 | Leonard et al. | 206/15.3 |
| 5,924,566 | A | * | 7/1999 | Gibbs | 206/361 |
| 5,971,141 | A | * | 10/1999 | Shafik | 206/225 |
| 5,984,100 | A | * | 11/1999 | Ramsey et al. | 206/581 |
| 6,038,709 | A | * | 3/2000 | Kent | 4/255.05 |
| 6,050,401 | A | * | 4/2000 | Michaelson | 206/225 |
| D425,744 | S | * | 5/2000 | McGuire | D6/551 |
| 6,109,429 | A | * | 8/2000 | Cunningham et al. | 206/15.2 |
| 6,193,059 | B1 | * | 2/2001 | Massaro | 206/225 |

FOREIGN PATENT DOCUMENTS

GB 2204566 A * 11/1988

* cited by examiner

*Primary Examiner*—Mickey Yu
*Assistant Examiner*—Troy G. Arnold

(57) ABSTRACT

A bathroom accessory in the form of three canisters with lids connected together, to conveniently store often needed tools near the bathroom commode. These tools include a suction-type plunger device, extra rolls of toilet tissue, and a brush to clean a toilet, all which can be accessed by lifting the lids, reaching in and pulling the tool upward and out of its canister. For store shelf compactness, storing, or moving this accessory, the invention also disassembles, and all of it's contents (minus the toilet paper) can be put inside the plunger canister, making an efficient size for shipping this product to the customer.

1 Claim, 3 Drawing Sheets

MULTI PURPOSE BATHROOM STORAGE ACCESSORY

BACKGROUND

1. Field of Invention

Figure 1:
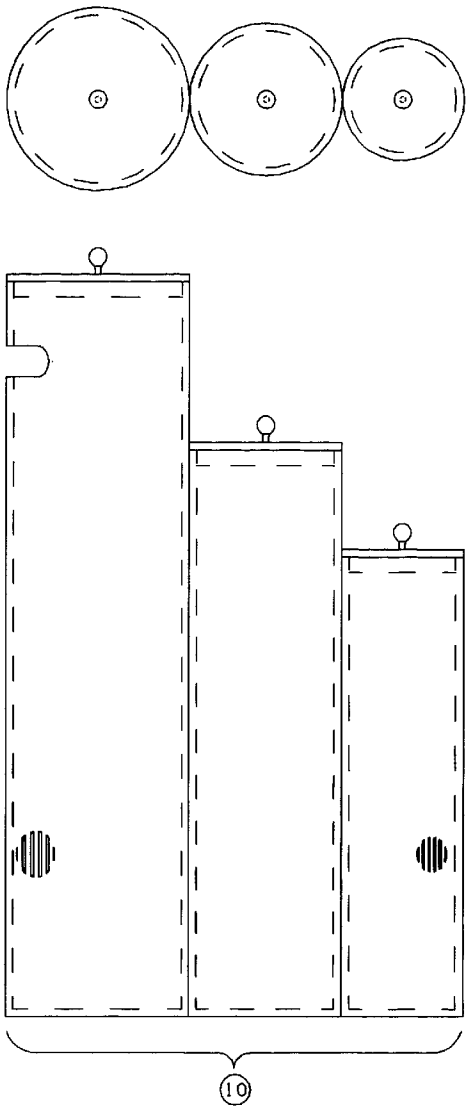

This invention related to bathroom accessories specifically to an improved multipurpose bathroom storage accessory.

2. Discussion of Prior Art

Originally, bathrooms were bothered by having no organized space to store and hide the suction type plunger, toilet paper, and toilet brush. This problem has been partially solved by the implementation of various bathroom accessories, but these had and still have significant problems: There are several prior art related to the storage of these bathroom utensils, but as I will point out, these prior art have failed where this invention will succeed. In the prior art U.S. Pat. No. 4,432,451 Hooser Feb. 21, 1984 she shows an accessory that stores a suction type plunger and four tolls of toilet paper, but what it fails to have is a toilet brush to complete the accessory and I also find the means of lifting the whole canister to access the plunger, both awkward and unpractical. Another patent that fails to fulfill all the necessary tools in a bathroom accessory is Des U.S. Pat. No. 356,893 Conmy Apr. 4, 1995. Here he shows a design that holds a plunger and toilet brush but does not have the toilet paper, and it also fails to enclose and hide these unsightly utensils. The utensils when exposed in this manner are easy access to small children whose curiosity might lead them to grab the germ friendly tools. Another example where the accessory fails to have all three tools is Des. U.S. Pat. No. 425,744 McGuire May 30, 2000. Des U.S. Pat. No. 403,906 Gotti Jan. 12, 1999 shows an accessory that is very gaudy looking and noticeable for an accessory that should be more discreet and refined, trying to bring as little attention as possible. This invention like Conmys leaves the toilet brush exposed to curious children and looks only to hold one roll of toilet tissue where mine holds several rolls. Accordingly, several objects and advantages of my invention are: it's very functional three way personality that fits comfortably next to the commode, where these necessary items are all to often needed. The clever design to which this accessory may be broke down and fit into its largest canister making it perfect for storing, moving and the least amount of shelf space used in the store, with the most product. An organized, attractive, and sanitary storage to keep the most cluttered, ugly, and dirty tools where they belong.

SUMMARY

In accordance with the present invention a bathroom accessory having three separate canisters with lids that can be attached together via there connectors. These canisters advantageously hold a suction type plunger, several rolls of toilet tissue, and a toilet brush.

CHECKLIST

FIG. 1

10. Multi purpose bathroom storage accessory

FIGS. 2 & 3

20. plunger canister
21. lid

22. decorative knob
23. handle
24. top female connector
25. bottom female connector
26. air ventilation
27. plunger handle
28. plunger suction type device
40. toilet paper canister
41. lid
42. decorative knob
43. top left male connector
44. bottom left male connector
45. top right male connector
46. bottom right male connector
47. top roll toilet paper
48. 2nd roll toilet paper
49. 3rd roll toilet paper
50. bottom roll toilet paper
51. hollow center
52. inner cardboard lining
60. toilet brush canister
61. lid
62. decorative knob
63. top female connector
64. bottom female connector
65. air ventilation
66. toilet brush

DETAILED DESCRIPTION

This invention is a multipurpose bathroom storage accessory, and more particularly a device and means for storing three different bathroom items most commonly used in the bathroom; a suction type plunger, extra toilet tissue rolls, and a toilet brush in an attractive three cylinder accessory.

The concept of this invention provide such a well needed storage for the "bathroom items" in such a clever and easily accessible, condensed bathroom accessory. The three cylinders storing the bathroom items are easily accessed by lifting a lid and then being able to utilize the commonly used bathroom items easily.

Suction type plungers are so functional looking in appearance, that most home owners would never store such an item beside the bathroom commode due to its unsightly appearance, although beside the bathroom commode is the best place to store the suction type plunger. In the event of need, the homeowner would accordingly like to have the suction type plunger in ready a distance for easy accessibility and use.

The storage of extra rolls of toilet tissue are also a needed item in close proximity to the bathroom commode. The homeowner however, due to the undesirable appearance of such said items, would store them perhaps under the sink where it is not as easily accessible especially if it is needed while using the commode. This invention would give the said homeowner extra rolls of toilet tissue in close proximity to the bathroom commode.

Accordingly the need of a toilet cleaning brush in close proximity to the commode is an obviously needed item to any homeowner. The close proximity of the toilet cleaning brush to the bathroom commode makes the item easily accessible for use at anytime needed. This invention provides a decorative alternative way to store the toilet cleaning brush in close proximity to the bathroom commode, allowing the homeowner easy accessibility to this item for its common use.

The above mentioned descriptions of the invention provide a broad and generalized view of the said invention presented. More particular in-depth details, concepts, and features of the invention will be described in detail with illustrated information in the body of the presentation provided in the following:

FIG. 1 is a pictorial view of the outside perspective of the storage canister device. This diagram shows the view of the invention in relative form. The following figures will illustrate in depth all the components of the invention.

Figure 2:
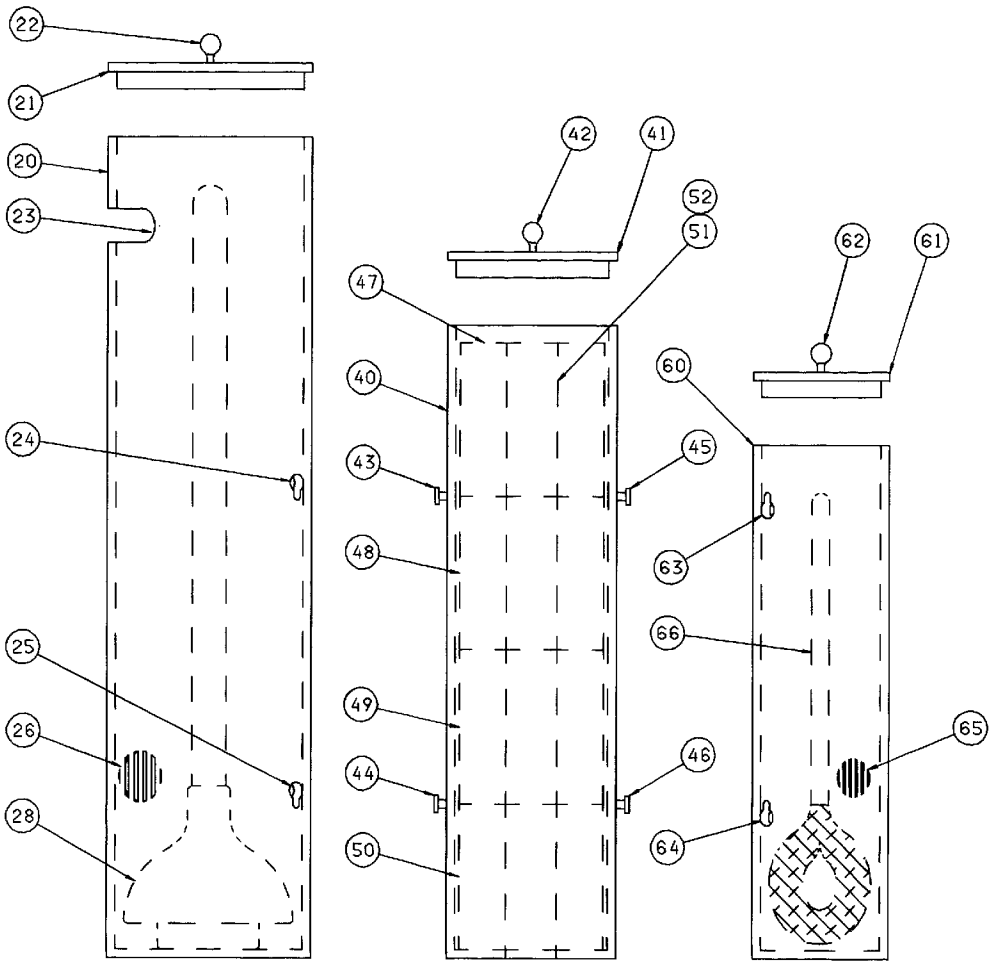

FIG. 2 is a pictorial view of the storage canister device previously described. The three cylinders are detached in the drawings to show the connection devices. The lids to the canisters are shown above the canisters to demonstrate their ability to be removed in relation to the functionality of the storage device.

Figure 3:
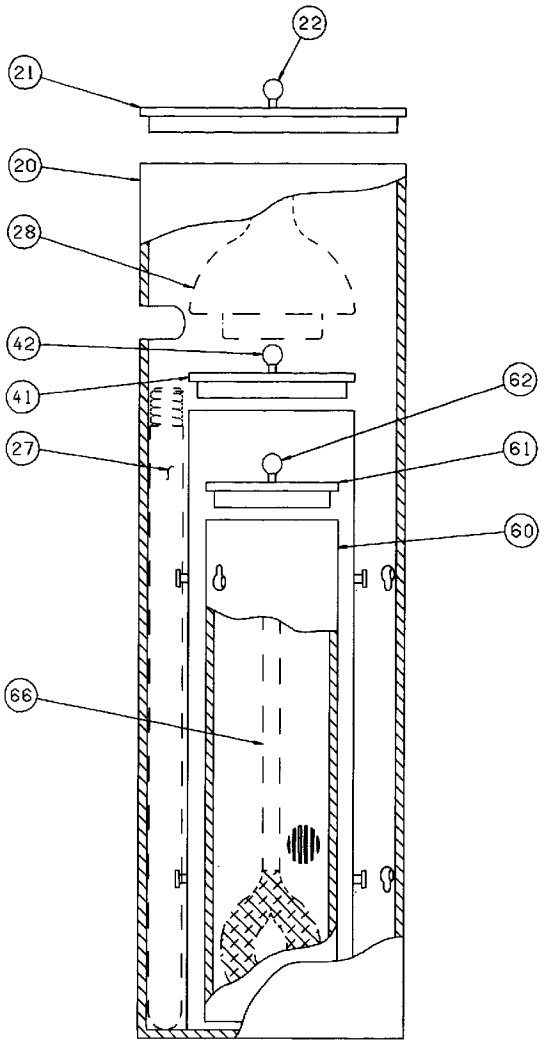

FIG. 3 is a pictorial view of the canister storage device in a disassembled storage and shipping perspective. The lids are shown detached to enable the viewer to see their respective place.

As shown in the detailed drawings, this multi purpose bathroom storage accessory 10 shows the concept for storing a suction type plunger device 27–28, toilet tissue in rolled form as shown 47–50, and lastly a toilet scrub brush 66, in a decorative accessory in which to store all needed items close to the bathroom commode The largest of the canisters 20 hold the suction type plunger device 27–28. This canister 20 also is the means for lifting or transporting the entire device by way of the kidney-shaped cavity 23 located near the top of container 20. This cavity 23 enables the homeowner to grip the device for movement to any location.

The next canister 40 is smaller in size and dimension than the first canister 20. This canister can store four rolls of toilet tissue 47–50, in an attractive and advantageous means.

The final canister 60 is smaller in size and dimension than the toilet paper canister 40. This cylinder stores the unsightly toilet brush 66 in a decorative canister device, which can be stored in close proximity to the bathroom commode.

All three canisters 20 40 60 are accompanied by lids 21 41 61 with decorative knobs 22 42 62. The lids 21 41 61 enable the homeowner to access all the contents 27 28 47–50 66 of the canisters 20 40 60 by simply lifting and removing the lids 21 41 61.

To gain access to the suction type plunger device 27–28 the homeowner would lift and pull upward on the lid 21 and then by grasping the suction type plunger device handle 27 and lifting the device upward until the device has cleared the top of the canister 20. Then the suction type plunger device can be used by the said homeowner and replaced into the canister 20 when done.

To gain access to the extra rolls of toilet tissue 47–50 the said homeowner would lift and pull upward on the lid 41, and then extract the toilet tissue 47 by holding your middle and fore finger together and inserting them into the hollow center of the toilet tissue, then spread the two said fingers until they are applying pressure to the inner cardboard lining 52 of the toilet tissue and then lift upward thereby removing the toilet tissue 47 for use by the said homeowner.

To gain access to the toilet brush 66 the said homeowner would lift and pull upward on the lid 61 and then by grasping the toilet brush 66 and lifting upward until the brush 66 has cleared the top of the canister 60. The said homeowner is then able to use this functional looking device and replace it into it's designated canister 60 when finished using.

The three canisters 20 40 60 are attached by notch 24 25 63 64 and pin 43–46 connectors. These connectors are similar to the way you mount a telephone to the wall. The toilet paper canister 40 has four pins 43–46 attached to it, two on the left side 43 44 and two on the right side 45 46. The suction type plunger canister 20 and the toilet brush canister 60 are equipped with the notches 24 25 63 64. Two notches 24 25 on canister 20 and two notches 63 64 on canister 60. The pins 43–46 are inserted into the notches 24 25 63 64 and pushed downward until the canisters 20 40 60 lock together.

After the said homeowner has used the suction type plunger device 28 or the toilet brush 66, and inserts them back to the designated canister 20 or 60 they will typically be wet in nature. The suction type plunger canister 20 and the toilet brush canister 60 both are equipped with air ventilation devices 26 65 which allow moisture to evaporate from the canisters and prevent an unwanted accumulation of moisture in the canisters 20 60.

The packing method for shipping and storing the invention is also an attractive concept. The suction type plunger canister 20 is able to utilize it's space by being able to fit the two smaller canisters 40 and 60 along with the lids 41 and 61, suction-type plunger device 27–28 and toilet brush 66 all inside the suction type plunger canister 20. This form can be accomplished by disassembling the invention 10, and making the three canisters 20 40 60 all individual by way of the pin 43–46 and notch 24 25 63 64 devices. Next unscrew the suction type plunger device 28 from the handle 27 and set aside. Then with the toilet brush 66 in its said canister 60, insert the toilet brush canister 60 into the empty toilet tissue canister 40. Then insert the toilet tissue canister 40 (which now houses canister 60) into the largest canister 20. Once completed you can reinsert the handle 27 of the suction type plunger device 28 between the wall of the toilet tissue canister 40 and the inner wall of the suction type plunger canister 20. The suction type plunger device 28 will fit on top of the toilet tissue canister lid 41 and below the largest canisters lid 21. All lids 21 41 61 stay on with their respective canister 20 40 60. This means of shipment and storage makes the invention more appealing to any manufacturer for stream line shipping and shelf space when displaying the invention in retail or department stores for purchase.

This invention can take many forms or colors, and be made of many different materials. Where a cylindrical shape is shown here, this bathroom accessory can be shaped from square to octagon, have textures rough or smooth the colors from clear to black, and while plastic seems to be the best choice material, metals, wicker, marble or ceramic, are all possibilities as well. It may also be made in a smaller or larger size to meet different household sizes. This accessory is capable of adapting and having more attachments in the future, but what they consist of will not be mentioned at this time.

I believe this accessory stands alone because all other prior art accessories have failed to combine these three most necessary items in one convenient attractive package. Not only is this the most ideal accessory for the bathroom, the way it breaks down for shipping and storage makes this accessory unique by having three storage canisters but they only take the room of one canister while on the shelf.

This invention as described in the preceding description shows the novel idea for storing three common bathroom items in a decorative storage canister advantageously located in close proximity to the bathroom commode for advantageous use by the said homeowner.

Modifications and alterations may be accomplished without leaving the scope of the novel concept of this invention; therefore, the invention is not limited to the specific embodiment or form or arrangement of parts listed therein or shown.

What is claimed is:

1. A storage device for bathroom items comprising:

three differently-sized hollow cylinders with one closed end and one open end each, joined laterally together side-by-side with pin and slot connectors, three removable lids with hand knobs, one fitting each cylinder, held in the open ends of the cylinders and thereby closing the open ends, a standard toilet plunger contained inside the largest cylinder, four standard rolls of toilet paper contained cud to end in the middle cylinder, and a standard toilet scrub brush contained inside the smallest cylinder.

* * * * *